US009985391B1

(12) United States Patent
Wang

(10) Patent No.: US 9,985,391 B1
(45) Date of Patent: May 29, 2018

(54) MALE CONNECTOR

(71) Applicant: Amphenol East Asia Electronic Technology (Shen Zhen) Co., Ltd., Shenzhen (CN)

(72) Inventor: Xiang Wang, Shenzhen (CN)

(73) Assignee: Amphenol East Asia Electronic Technology (Shen Zhen) Co., Ltd., Shenzhen (CN)

( * ) Notice: Subject to any disclaimer, the term of this patent is extended or adjusted under 35 U.S.C. 154(b) by 0 days. days.

(21) Appl. No.: 15/610,727

(22) Filed: Jun. 1, 2017

(51) Int. Cl.
*H01R 12/00* (2006.01)
*H01R 13/6581* (2011.01)
*H01R 13/629* (2006.01)

(52) U.S. Cl.
CPC ..... *H01R 13/6581* (2013.01); *H01R 13/629* (2013.01)

(58) Field of Classification Search
CPC ..... H01R 12/716; H05K 3/368; H05K 2201/10189
USPC ..... 439/74, 71, 70, 330, 331, 525, 526, 357
See application file for complete search history.

(56) References Cited

U.S. PATENT DOCUMENTS 8,968,009 B2 * 3/2015 Chen ..... H01R 12/7088 439/79
9,190,750 B2 * 11/2015 Takeuchi ..... H01R 12/716
2007/0010110 A1 * 1/2007 Ono ..... H01R 12/62 439/74

* cited by examiner

*Primary Examiner* — Phuong Chi T Nguyen
(74) *Attorney, Agent, or Firm* — Maier & Maier, PLLC

(57) ABSTRACT

A male connector, particularly to a new connector having an effective shielding function, which includes a conductive shielding, a set of terminals and a connector body. The connector body with a cavity in which the set of terminals can be accommodated is made from plastic cement. The set of terminal is located within the cavity of the connector body. The conductive shielding is in the shape of 'm' and located at the far plugging ends of the connector body; the conductive shielding includes three contacting areas; the plugging end of each of the contacting areas has a slot. In a further optimized technical solution, the new male connector includes fixing holes located at its two sides respectively.

1 Claim, 1 Drawing Sheet

MALE CONNECTOR

TECHNICAL FIELD

The present application relates to a male connector, particularly to a new connector having an effective shielding function.

BACKGROUND

With electromagnetic spectrum crowdedly distributed and electromagnetic power density drastically increased and many equipments used together, electromagnetic environment within systems has been increasingly worsening. Connectors, as essential part of an electrical system, have an effect on the data transmission rates and signal transmission qualities of the system. Therefore, the electromagnetic shielding plays a more and more important role, for worse electromagnetic shielding brings about garbage signals or noises due to crosstalk and linkage and so forth, which ultimately does harm to the stability and lifespan of the whole system.

SUMMARY OF THE APPLICATION

To solve above described technical problems, the present application provides a connector having an effective electromagnetic shielding function.

To achieve above described objective, the technical solutions to the application are detailed as follows: a new male connector comprises a conductive shielding, a set of terminals and a connector body.

The connector body with a cavity in which the set of terminals can be accommodated is made from plastic cement.

The set of terminals is located within the cavity of the connector body.

The conductive shielding is in the shape of 'm' and located at the far plugging ends of the connector body. The conductive shielding includes three contacting areas located at a plugging end of the conductive shielding, namely at the three foot-shaped sections of the m-shaped structure. There is one slot at the near plugging end of each contacting area.

In a further optimized technical solution, there are fixing holes located at the two sides of the connector body respectively.

Compared with the prior art, the beneficial effects of the present application are that: the provided connector has an effective electromagnetic shielding function, and the specific structure of the conductive shielding has an effect of conductive grounding and the functions of electromagnetic shielding and crosstalk prevention as well; wherein the m-shaped structure makes it connected with the ground pin and therefore has the function of grounding conduction; there is one slot at the near plugging end of each contacting area so that the conductive shielding can absorb electromagnetic waves, avoid crosstalk, so as to improve the communication efficiency of the connector.

DETAILED DESCRIPTION

The present application will be detailed in connection with FIGS. 1 to 2 and the specific embodiments as well, which are in no way intended to limit the present application.

Embodiment 1

Figure 1:
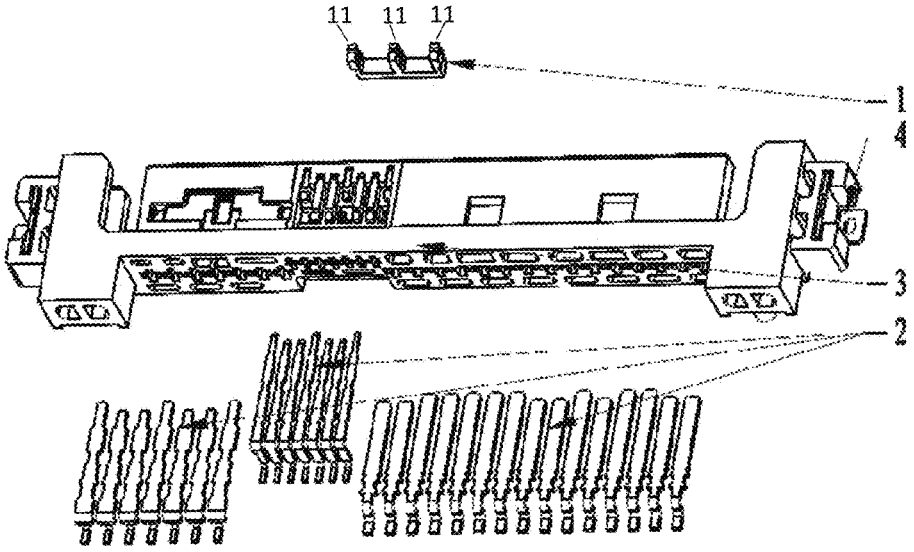
FIG. 1 is an exploded view of a new male connector.

As shown in FIG. 1, a new male connector comprises a conductive shielding 1, a set of terminals 2, a connector body 3 and fixing holes 4. The connector body 3 with a cavity in which the set of terminals 2 can be accommodated is made from plastic cement.

The set of terminals 2 is located within the cavity of the connector body 3.

The conductive shielding 1 is in the shape of 'm' and located at the far plugging ends of the connector body 3. The conductive shielding 1 includes three contacting areas 11 located at the plugging end of the conductive shielding 1, namely at the three foot-shaped sections of the m-shaped structure.

Figure 2:
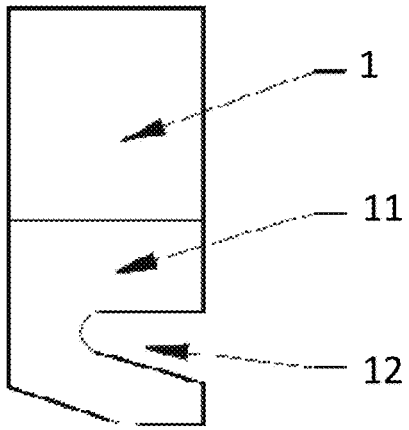
FIG. 2 is a side view of a conductive shielding.

As shown in FIG. 2, each of the plugging end of the contacting areas 11 has a slot 12.

The fixing holes 4 are located at the two sides of the connector body 3 respectively.

In light of general technical knowledge, the present technical solution can be achieved by other embodiments which are not departed from spiritual substance or essential features of the application. Therefore, above described embodiment is simply illustrative in any way and is not intended to limit the application. All the changes within the range of the application or its equivalent are included in the application itself.

The invention claimed is:

1. A shield male connector comprising:

a pair of conductive shields, a set of terminals, and a connector body, the connector body with a cavity in which the set of terminals is made from a plastic cement;

the set of terminals is located within the cavity of the connector body; wherein the conductive shields, are in the shape of letter M and located at plugging end edges of the connector body;

the conductive shields includes three contact areas located at the plugging end edges of the conductive shields, namely at the three foot-shaped sections of the M shaped structure;

the pair of conductive shields are inserted into a pairs of corresponding fixing holes, which are extending from the plugging end edges of the connector body; the conducive shields have slots being used to connect electromagnetic magnets.

* * * * *